US007567175B2

(12) United States Patent
Takahashi

(10) Patent No.: US 7,567,175 B2
(45) Date of Patent: Jul. 28, 2009

(54) MONITORING APPARATUS FOR HOUSING

(75) Inventor: Masahiro Takahashi, Tokyo (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 318 days.

(21) Appl. No.: 11/727,076

(22) Filed: Mar. 23, 2007

(65) Prior Publication Data

US 2007/0222616 A1 Sep. 27, 2007

(30) Foreign Application Priority Data

Mar. 27, 2006 (JP) ..... P2006-084351

(51) Int. Cl.
*G08B 13/08* (2006.01)

(52) U.S. Cl. ..... 340/545.6; 340/545.4; 340/546; 340/566; 340/693.9; 340/572.1; 340/572.4; 340/572.7

(58) Field of Classification Search ..... 340/545.6, 340/545.4, 546, 566, 693.9, 572.1, 572.4, 340/572.7

See application file for complete search history.

(56) References Cited

U.S. PATENT DOCUMENTS

| | | | | |
|---|---|---|---|---|
| 4,257,038 | A * | 3/1981 | Rounds et al. | 340/539.16 |
| 5,615,625 | A | 4/1997 | Cassidy et al. | |
| 6,259,356 | B1 * | 7/2001 | Tamaoki et al. | 340/309.7 |
| 6,472,993 | B1 * | 10/2002 | Addy | 340/686.1 |
| 6,575,833 | B1 | 6/2003 | Stockdale | |
| 6,646,550 | B1 | 11/2003 | Runyon et al. | |
| 6,921,990 | B1 | 7/2005 | Higgins | |
| 7,113,091 | B2 * | 9/2006 | Script et al. | 340/546 |
| 7,330,108 | B2 | 2/2008 | Thomas | |
| 7,342,497 | B2 | 3/2008 | Chung et al. | |
| 2004/0070506 | A1 | 4/2004 | Runyon et al. | |
| 2005/0010525 | A1 | 1/2005 | Ross et al. | |
| 2005/0242957 | A1 | 11/2005 | Lindsay et al. | |
| 2006/0055552 | A1 | 3/2006 | Chung et al. | |
| 2006/0087436 | A1 | 4/2006 | Reddy et al. | |
| 2007/0013521 | A1 | 1/2007 | Lindsay et al. | |

FOREIGN PATENT DOCUMENTS

| | | |
|---|---|---|
| DE | 101 02 283 | 9/2001 |
| EP | 0 692 599 A1 | 1/1996 |
| JP | 2001-283356 | 10/2001 |
| KR | 20-0379853 | 3/2005 |
| WO | WO 2005/111925 | 11/2005 |
| WO | WO 2005/111961 A | 11/2005 |

* cited by examiner

*Primary Examiner*—Tai T Nguyen
(74) *Attorney, Agent, or Firm*—Nixon & Vanderhye P.C.

(57) ABSTRACT

A monitoring apparatus for a housing includes: an opening/closing section provided to the housing; a detection section provided to the housing, having a wireless IC chip in which alarm information is pre-stored, and an antenna driving the wireless IC chip with a driving electric power induced by receiving a predetermined radio wave and wirelessly transmitting the alarm information outputted from the wireless IC chip; a reader provided independently outside the housing, and outputting the predetermined radio wave and receiving the alarm information transmitted from the detection section; and a restriction section restricting a transmission of the alarm information when the opening/closing section is in a closed state.

14 Claims, 5 Drawing Sheets

MONITORING APPARATUS FOR HOUSING

BACKGROUND OF THE INVENTION

1. Field of the Invention

The present invention relates to a monitoring apparatus for a housing of a bill and coin processing device, etc.

This application claims priority from Japanese Patent Application No. 2006-84351, filed on Mar. 27, 2006, the contents of which are incorporated herein by reference.

2. Description of Related Art

Conventionally, monitoring apparatuses for a housing that monitor door(s), drawer(s), etc., are known.

For example, a monitoring apparatus as disclosed in Japanese Unexamined Patent Application, First Publication 2001-283356 is known that uses a sensor to detect that someone other than the qualified operators has unlocked and opened the monitored apparatus such as a safe or a bill and coin processing device, and reports the fact, through the main unit to which the sensor is connected wirelessly or with wires, to the security firm, etc., or raises an alarm.

To the door(s) or drawer(s) provided to the housing of the above-described monitored apparatus, sensors that detect opening/closing or locking/unlocking of the door(s) or the drawer(s) are respectively attached. Generally, these sensors need electric power. Electric power is supplied from the power supply circuit of the monitored apparatus.

Therefore, there is a problem in that once the power supply from the outside to the monitored apparatus is shut off, the power supply to the sensors also ceases, thus causing the sensors to stop.

On the one hand, to enable the above sensors to be actuated even if the power supply to the monitored apparatus is shut off, the following configurations are known: a configuration in which electric power is supplied to the monitored apparatus directly from the main unit of the monitoring machine installed outside the housing of the monitored apparatus and a configuration in which a dry contact is provided. However, in such configurations, wiring from the main unit of the monitoring machine is required. Therefore, for example, in the relocation of the monitored apparatus, the place for the apparatus is limited within the range the existing wires can reach, or there is need for a new wiring.

On the other hand, as for the power source of the above sensors, a backup battery can be provided inside the monitored apparatus. However, this will result in an enlarged apparatus due to the installment of the battery, increase in cost due to the increased number of component parts or to maintenance of the battery, etc.

SUMMARY OF THE INVENTION

This invention has been achieved in view of such problems, and has an object to provide a monitoring apparatus that can monitor an opening/closing section such as a door or drawer of a monitored apparatus such as a safe, a bill and coin processing device, etc., even when no electric power is supplied to the monitored apparatus, and that can omit a wiring from a main unit of the monitoring apparatus to the monitored apparatus, without making the monitored apparatus large.

To address the above problems, a monitoring apparatus for a housing of this invention includes: an opening/closing section provided to the housing; a detection section provided to the housing, having a wireless IC chip in which alarm information is pre-stored, and an antenna driving the wireless IC chip with a driving electric power induced by receiving a predetermined radio wave and wirelessly transmitting the alarm information outputted from the wireless IC chip; a reader provided independently outside the housing, and outputting the predetermined radio wave and receiving the alarm information transmitted from the detection section; and a restriction section restricting a transmission of the alarm information when the opening/closing section is in a closed state.

With this configuration, the predetermined radio wave transmitted from the reader independently provided outside the housing can be received by the antenna of the detection section provided to the housing and the driving electric power induced in the antenna by this predetermined radio wave can be supplied to the wireless IC chip, of the detection section, in which alarm information is previously stored. Therefore, even if there is no power source in the housing, the wireless IC chip can be driven.

When the opening/closing section of the housing is in the closed state, the restriction section restricts transmission of the alarm information, thus preventing the reader from receiving the alarm information. On the other hand, when the opening/closing section of the housing is in the open state, the restriction section lifts the restriction on transmission of the alarm information. Thus, it is possible to receive the alarm information wirelessly transmitted from the detection section by the reader. As a result, when the reader can receive the alarm information, it is possible to determine that the opening/closing section is in the open state.

Therefore, there is no need for wiring between the main unit of the monitoring apparatus and the housing, which makes the relocation of the housing easier.

Furthermore, since no battery is required inside the housing, cost reduction and downsizing of the housing can be achieved by suppressing the number of component parts and the frequency of maintenance.

It is preferable that, in the monitoring apparatus for a housing of this invention, the alarm information include ID data of an occurrence position of an opening/closing operation for identifying the occurrence position of the opening/closing operation of the opening/closing section, and the ID data of the occurrence position of the opening/closing operation include ID data assigned to every housing for identifying the housing or ID data assigned for every opening/closing section for identifying the opening/closing section.

With this configuration, the housing in which an opening/closing operation has occurred can be identified by ID data of the occurrence position of the opening/closing operation. For example, when a plurality of housings is installed, the housing can be identified based on the ID data of the occurrence position of the opening/closing operation included in the alarm information. Furthermore, when a plurality of opening/closing positions is provided in the housing, the opening/closing section in which the opening/closing operation has occurred can be identified based on the ID data assigned for every opening/closing section. Therefore, an advantage is obtained in that the position in which the opening/closing operation has occurred can be identified speedily.

It is preferable that, in the monitoring apparatus for a housing of this invention, the opening/closing section be a drawer, and the alarm information include information indicating that the drawer is in a pulled-out state.

With this configuration, when the drawer is pulled out, alarm information is transmitted from the detection section. When this alarm information is received by the reader, the reader can detect that the drawer provided to the housing is in the pulled-out state. As a result, an advantage is obtained in that the reader side can speedily detect that what has been opened is the drawer.

It is preferable that, in the monitoring apparatus for a housing of this invention, the opening/closing section be a door, and the alarm information include information indicating that the door is in an open state.

With this configuration, when the door is opened, alarm information is transmitted from the detection section. When this alarm information is received by the reader, that the door provided to the housing is in the open state can be detected.

Therefore, an advantage is obtained in that the reader can speedily detect that what has been opened is the door.

It is preferable that, in the monitoring apparatus for a housing of this invention, the reader include a storage section that, in receiving the alarm information, stores the alarm information and an occurrence time of an opening/closing operation when the reader received the alarm information.

With this configuration, the storage section can store the time when the reader received alarm information as well as the occurrence time of the opening/closing operation when the reader received the alarm information. Therefore, an advantage is obtained in that an occurrence time of an opening/closing operation when the opening/closing section was opened can be confirmed again at any time.

It is preferable that, in the monitoring apparatus for a housing of this invention, the restriction section be made of a shielding material that shields the predetermined radio wave.

With this configuration, for example, only coating the housing with the shielding material can prevent the predetermined radio wave from reaching the antenna by the shielding material when the opening/closing section is in the closed state. On the other hand, when the opening/closing section is opened, the shield formed by the shielding material can be canceled to allow the predetermined radio wave to reach the antenna.

As a result, the wireless IC chip can be driven to transmit alarm information only when the opening/closing section is open. Therefore, an advantage is obtained of being applicable to existing housings with ease since only coating the housing with a shielding material is needed.

It is preferable that, in the monitoring apparatus for a housing of this invention, the restriction section be a switch that is in a conductive state only when the opening/closing section is in an open state, and the switch be arranged between the wireless IC chip and the antenna.

With this configuration, for example, only by providing a switch so as to operate in association with the opening/closing of the opening/closing section, disconnecting the antenna and the wireless IC chip from each other when the opening/closing section is in the closed state, it is possible to shut off the power supply to the wireless IC chip.

On the other hand, when the opening/closing section is in the open state, the antenna and the wireless IC chip are connected to supply the driving electric power induced in the antenna to the wireless IC chip for driving the wireless IC chip, it is possible to wirelessly transmit the alarm information.

Therefore, an advantage is obtained of being applicable to existing housings with ease since only installation of a switch is needed.

It is preferable that, in the monitoring apparatus for a housing of this invention, at least the antenna of the detection section be provided on a backside of the housing.

With this configuration, improper actions in which the opening/closing section is opened while the wirelessly transmitted alarm information is shut off, such as an intentional shielding of the antenna, can be prevented. Therefore, an advantage is obtained in that reliability of monitoring can be improved.

It is preferable that, in the monitoring apparatus for a housing of this invention, the reader be located at a position facing the backside of the housing.

With this configuration, improper actions in which the opening/closing section is opened while the alarm information wirelessly transmitted from the detection section is shut off, such as an intentional shielding of the reader, can be prevented. Therefore, an advantage is obtained in that reliability of monitoring can be improved.

It is preferable that the monitoring apparatus for a housing of this invention further include an alarm system connected to the reader, including an alarm section that raise an alarm, and controlling the alarm section based on the alarm information received by the reader.

With this configuration, the alarm system can control the alarm section based on the alarm information received by the reader. Therefore, the alarm section can be actuated to raise an alarm when an abnormal condition such as a reception of alarm information occurs. This works as, for example, an alarm to the one who has taken an improper action. As a result, security effect can be improved.

It is preferable that the monitoring apparatus for a housing of this invention further include an alarm system connected to the reader, and including a controller that transmits a detection signal to a monitoring center when the alarm information is received from the reader.

With this configuration, on an occurrence of an abnormal condition, the occurrence can be reported to the monitoring center. As a result, for example, security staff can be speedily dispatched to the occurrence location. Therefore, an advantage is obtained in that a monitoring level can be improved.

It is preferable that, in the monitoring apparatus for a housing of this invention, a plurality of the readers be provided.

With this configuration, alarm information transmitted from the detection section can be received by a reader capable of communication, among the plurality of the readers. As a result, an opening/closing operation of the opening/closing section can be detected with reliability without being affected by radio wave conditions. Therefore, an advantage is obtained in that reliability can be improved.

It is preferable that, in the monitoring apparatus for a housing of this invention, the housing be a housing of a bill and coin processing device.

With this configuration, the open/closed state of a door or a drawer provided to a bill and coin processing device can be monitored. Therefore, an advantage is obtained in that improper taking out of bill(s) and coin(s) stored in the bill and coin processing device can be prevented.

It is preferable that, in the monitoring apparatus for a housing of this invention, the reader be set so as to be activated upon shut-off of electric power for the bill and coin processing device.

With this configuration, the opened/closed state of an opening/closing section provided to the bill and coin processing device can be monitored only when the qualified operator is away from the bill and coin processing device after it is shut down, e.g., during night or on national holidays. Therefore, an advantage is obtained in that transmission and reception of alarm information that is not improper can be prevented.

DETAILED DESCRIPTION OF THE INVENTION

Figure 1:
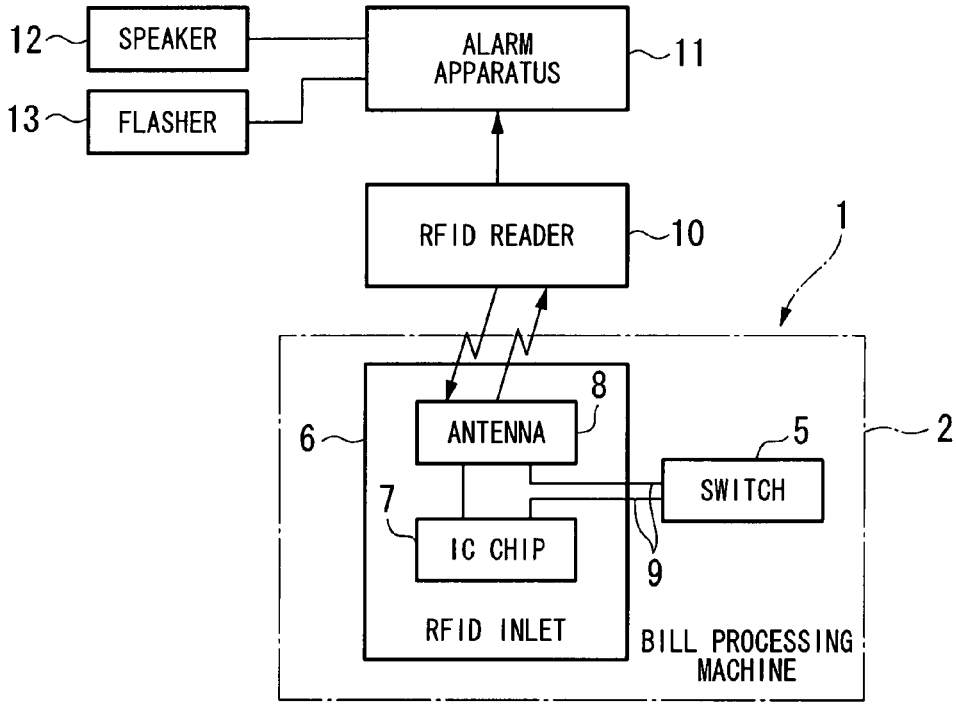
FIG. 1 is a block diagram of a monitoring apparatus according to a first embodiment of this invention.
Figure 2:
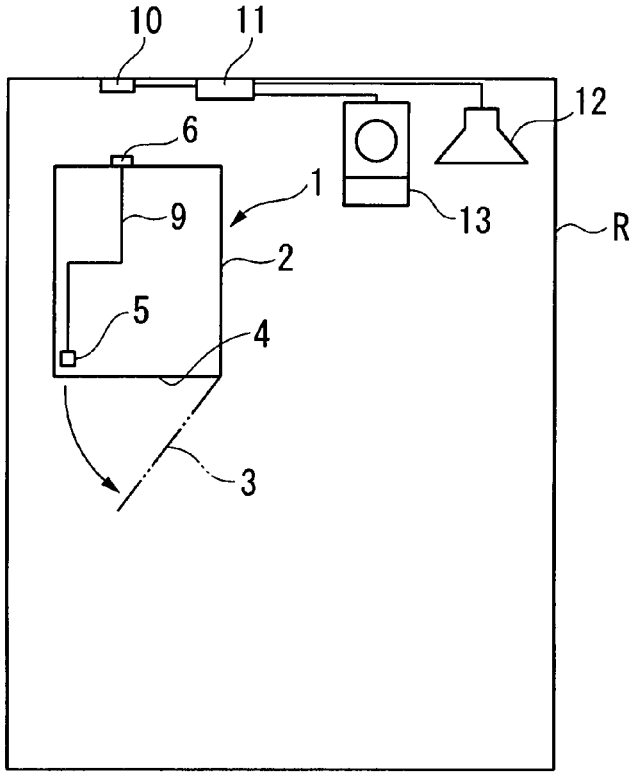
FIG. 2 is a schematic structural diagram of the monitoring apparatus according to the first embodiment of this invention.
Figure 3:
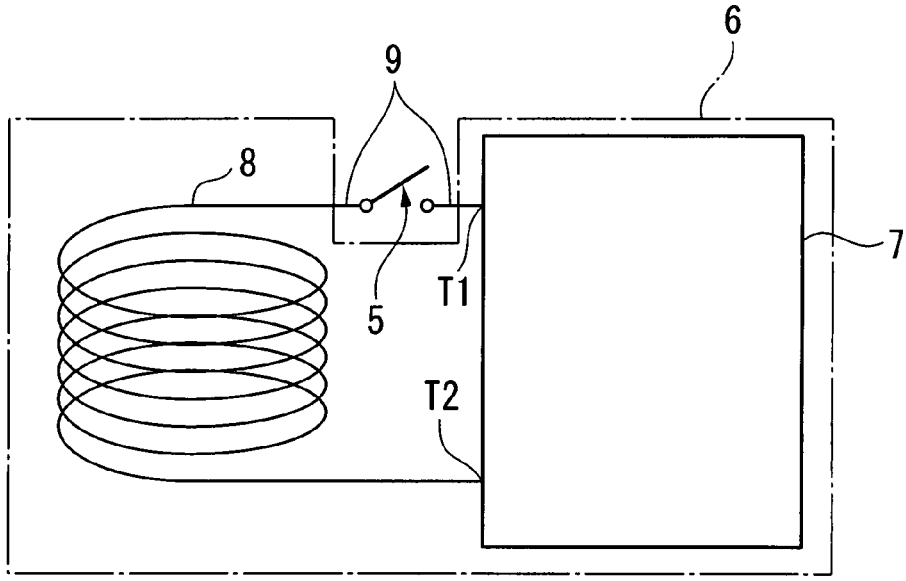
FIG. 3 is a schematic structural diagram of an RFID inlet according to the first embodiment of this invention.

Hereunder is a description of a monitoring apparatus for a housing according to a first embodiment of this invention with reference to FIGS. 1 to 3.

FIG. 1 shows a general structure of a monitoring apparatus of this embodiment. The monitoring apparatus shown in FIG. 1 is an example of a monitoring apparatus for a housing of a bill processing machine installed, as a monitored apparatus, in a predetermined room such as in a bank or a shop.

As shown in FIGS. 1 and 2, a bill processing machine 1 is installed in a predetermined room R (see FIG. 2).

The bill processing machine 1 receives and pays out bill(s). Received bill(s) can be stocked inside a housing 2 of the bill processing machine 1.

More specifically, the bill processing machine 1 takes in one or more bills, one by one, that an operator has put in the cash receptor. Subsequently, in the bill processing machine 1 discriminates the types of the bills, real bills from forged bills, good bills from damaged bills, etc., in a discrimination portion, while counting the bills.

Next, the bill processing machine 1 determines the return or acceptance of the bills in response to the subsequent confirmation operation by the operator. In the case in which the operator performs an operation indicative of paying out bill(s), the bill processing machine 1 pays out the designated number of designated type(s) of bill(s).

Inside the housing 2, a plurality of stackers for storing received bills and bills to be paid out according to the types of bill is provided.

A plurality of the bill processing machines may be installed in one room R. However, only one machine is shown in FIG. 1 for convenience's sake of illustration.

As shown in FIGS. 1 and 2, the bill processing machine 1 includes a door 3 (opening/closing section) on the front side thereof. The door 3 is openably supported at an opening 4 of the housing 2 of the bill processing machine 1 via a hinge (not shown in the figures).

A switch 5 (restriction section) such as a micro switch is provided to a periphery of the opening 4 to which the door 3 is provided.

The switch 5 is provided, for example, at a position that is depressed by the door 3 when the door 3 is in the closed state. By receiving a depressing force from the door 3, a contact point of the switch 5 opens. On the other hand, when the door 3 is opened to cancel the depressing force, the contact point of the switch 5 is short-circuited.

Here, by opening the door 3, it is possible to take out a stacker stored inside the bill processing machine 1.

In the above-mentioned housing 2, one in which the door 3 is supported by a hinge is explained by way of example. However, for example, a sliding door, etc., may be used as the door 3, as long as the door 3 can be opened and closed.

The above-described switch 5 is connected to a Radio Frequency IDentification (RFID) inlet 6 (detection section) provided so as to be exposed on the backside of the housing 2. The RFID inlet 6 includes, as shown in FIG. 3, an IC chip 7 (wireless IC chip). In the IC chip is stored, for example, ID data assigned for every bill processing machine, as alarm information in accordance with a position in which the RFID inlet 6 is installed. Furthermore, in the case such as where a plurality of the doors 3 are provided to the housing of the bill processing machine, ID data for identifying an occurrence position of an opening/closing operation (occurrence position of an abnormal condition), such as ID data assigned for every door 3, is stored in the IC chip 7.

To two terminals T1 and T2 of the IC chip 7 is connected an antenna 8 that wirelessly transmits alarm information previously stored in the IC chip 7.

The antenna 8 is formed in a coil. The antenna 8 is configured such that enough electric power driving the IC chip 7 is induced in the antenna 8 by receiving a predetermined radio wave outputted from an RFID reader 10 which will be described later.

Between one terminal T1 of the IC chip 7 and the antenna 8, the above-described switch 5 is arranged via a wiring 9 drawn out to the outside of the RFID inlet 6.

Here, the above-described predetermined radio wave refers to a radio wave at a specified frequency band conforming to conditions such as the number of windings and winding diameter of the antenna 8. The antenna 8 is configured such that electric power driving the IC chip 7 is not generated in the antenna 8 by an extraneous noise, etc., that is, a radio wave at a frequency band other than the specific frequency band.

Therefore, when the door 3 is opened, the above-described switch 5 is short-circuited. Electric power induced in the antenna 8 is then supplied to the IC chip 7 to drive the IC chip 7. Thus, alarm information previously stored in the IC chip 7 is wirelessly transmitted via the antenna 8.

On the other hand, in the room R in which the bill processing machine 1 is installed, an RFID reader (reader) 10 is installed at a position facing the backside of the bill processing machine 1, that is, on a wall facing the RFID inlet 6.

The RFID reader 10 outputs a predetermined radio wave for driving the IC chip 7 toward the RFID inlet 6, and receives alarm information wirelessly transmitted from the RFID inlet 6. The RFID reader 10 is connected to an alarm apparatus 11 (alarm system).

The alarm information received by the RFID reader 10 is transmitted to the alarm apparatus 11. On the other hand, electric power for driving the RFID reader 10 is supplied from the alarm apparatus 11 to the RFID reader 10.

The RFID reader 10 includes a memory (not shown) that stores a variety of data. When the RFID reader 10 receives the alarm information transmitted from the RFID inlet 6, the memory stores the received alarm information, and additionally stores the time when the alarm is received as an occurrence time of an opening/closing operation of the door 3 (occurrence time of an abnormal condition).

The alarm information and the occurrence time of the opening/closing operation of the door 3 (occurrence time of the abnormal condition) that are stored in the memory can be displayed on a display, etc., based on a call request from, for example, a dedicated terminal connectable to the RFID reader 10 wirelessly or with wires, or from the alarm apparatus 11 connected to the RFID reader 10.

The above-mentioned memory may be provided to the alarm apparatus 11 that receives the alarm information from the RFID reader 10.

To the alarm apparatus 11, a speaker 12 (alarm section) and a flasher 13 (alarm section) are connected. When the alarm information transmitted from the RFID reader 10 is received, the alarm apparatus 11 determines that an opening/closing operation of the door 3, that is, an abnormal condition has occurred, and controls the speaker 12 and the flasher 13 to raise an alarm.

Here, the alarm apparatus 11 may be adapted to work with a power switch (not shown) of the bill processing machine 1 and to be programmed to supply electric power to the RFID reader 10 only when the bill processing machine 1 is powered off.

In the configuration above, the RFID reader 10 is located on the wall facing the backside of the bill processing machine 1 so as to prevent improper actions such as an intentionally communication interference between the RFID inlet 6 and the RFID reader 10.

However, basically, the RFID reader 10 may be installed anywhere, for example, on the ceiling, as long as the RFID reader 10 is located at a position that allows communication with the RFID inlet 6.

That is, with the configuration of the first embodiment above, even if power supply to the bill processing machine 1 is stopped when the qualified operator is away from the bill processing machine 1, e.g., during night or on holidays, a predetermined radio wave is transmitted from the RFID reader 10 to the inside of the room R where the bill processing machine 1 is installed, as long as power is supplied to the alarm apparatus 11. As a result, electromotive force is generated in the antenna 8 that has received the predetermined radio wave.

When the door 3 of the bill processing machine 1 is opened, the switch 5 is short-circuited. Electric power induced in the antenna 8 is then supplied to the IC chip 7 via the terminals T1 and T2 of the IC chip 7 to drive the IC chip 7.

When the IC chip 7 is driven, the alarm information is wirelessly transmitted via the antenna 8. The transmitted alarm information is then received by the RFID reader 10. Thus, the received alarm information and an occurrence time of an opening/closing operation of the door 3, which is the time when the alarm information is received, are stored in the memory.

The alarm information received by the RFID reader 10 is transmitted to the alarm apparatus 11. In receiving the alarm information, the alarm apparatus 11 determines that the door 3 is opened, and controls the speaker 12 and the flasher 13 to raise an alarm.

Therefore, according to the first embodiment above, electromotive force induced by a predetermined radio wave transmitted from the RFID reader 10 can drive the IC chip 7. Furthermore, the alarm information can be wirelessly transmitted only when the door 3 of the housing is open. As a result, it is possible to determine that the door 3 is open when the alarm information is received by the RFID reader 10. For example, even when power supply to the bill processing machine 1 is stopped, opening of the door 3 can be detected.

Therefore, the opening/closing state of the door 3 provided to the bill processing machine 1 can be monitored, and thus can prevent improper taking out of the bills stored in the housing 2 of the bill processing machine 1.

By ID data, included in alarm information, of the occurrence position of the opening/closing operation of the door 3 for identifying the occurrence position of the opening/closing operation of the door 3, the housing 2 in which the opening/closing operation has occurred can be identified based on the ID data assigned for every housing 2.

Furthermore, in the case in which a plurality of the doors 3 are provided, the door 3 in which the opening/closing operation has occurred can be identified based on the ID data assigned for every door 3. As a result, the position in which the opening/closing operation of the door 3 (abnormal condition) has occurred can be speedily identified.

Furthermore, the wiring between the alarm apparatus 11 and the housing 2 can be omitted. Therefore, relocation of the housing 2 is made easier, and cost can be lowered by reducing the number of component parts and the frequency of maintenance without making the bill processing machine 1 larger.

By providing the RFID inlet 6 on the backside of the housing 2, it is possible to prevent improper actions in which the door 3 is opened while the wirelessly transmitted alarm information is shut off, such as an intentional shielding of the antenna. Therefore, reliability of monitoring can be improved.

Similarly, by installing of the RFID reader 10 at a position facing the RFID inlet 6, it is possible to prevent improper actions in which the door 3 is opened while the alarm information transmitted from the RFID inlet 6 is shut off, such as an intentional shielding of the RFID reader 10. Therefore, reliability of monitoring can be improved.

When the door 3 is opened and the antenna 8 receives the predetermined radio wave transmitted from the RFID reader 10, electric power is supplied to the IC chip 7 and alarm information is transmitted from the RFID inlet 6. With the alarm information being received by the RFID reader 10, it is possible to detect that the door 3 provided to the housing 2 is in the open state. As a result, the RFID reader 10 can speedily identify that what has been opened is the door 3.

With the antenna 8 of the RFID inlet 6 being exposed from the backside of the housing 2, and the RFID reader 10 being installed on the wall facing the RFID inlet 6, improper actions in which the opening/closing section is opened while the wirelessly transmitted alarm information is shut off, such as an intentional shielding of the antenna 8, can be prevented. Therefore, reliability of monitoring can be improved.

Electric power can be supplied to the RFID reader 10 only during the period of time in which monitoring is required, e.g., during night or on national holidays, when the qualified operator is away from the bill processing device 1 after it is shut down, so as to monitor the opening/closing state of the door 3 provided to the bill processing machine 1.

Therefore, transmission and reception of alarm information which is not improper can be prevented.

The alarm apparatus 11 can control the speaker 12 and the flasher 13 based on the alarm information received by the RFID reader 10. Thus, the alarm apparatus 11 can cause the speaker 12 to make a warning sound and cause the flasher 13 to flash on an occurrence of an opening/closing operation (abnormal condition) of the door 3 such as will bring the RFID reader 10 to receive alarm information. This works as a warning to the one who has taken an improper action. As a result, security effect can be improved.

Next, another bill processing machine of the above-described first embodiment will be described with reference to FIG. 4.

In the other bill processing machine of the first embodiment, the above described bill processing machine 1 including the door 3 is replaced by the bill processing machine 1 including a stacker carrier 14 (opening/closing section).

Therefore, description will be made in the condition that similar reference numerals denote similar parts. Description of overlapping parts is omitted.

Figure 4:
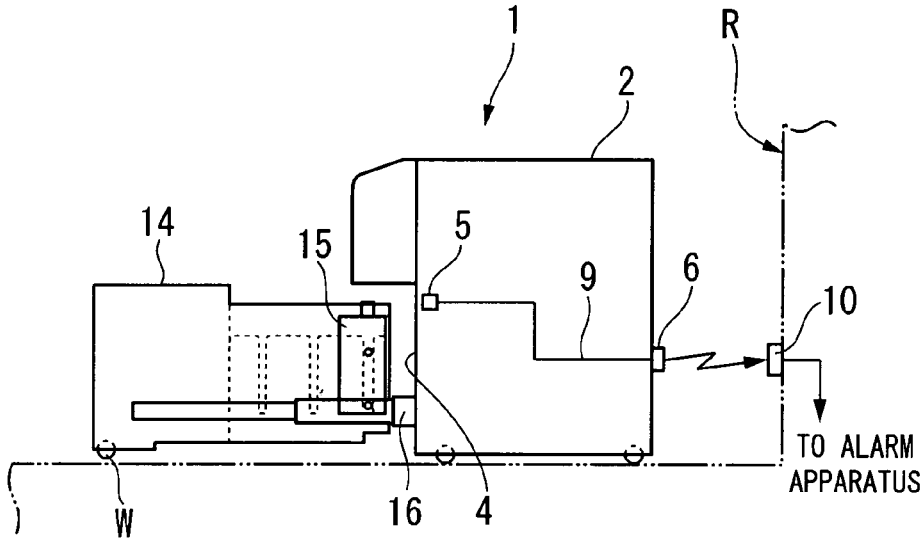
FIG. 4 is a schematic structural diagram of another monitoring apparatus according to the first embodiment of this invention.

As shown in FIG. 4, to the bill processing machine 1, the stacker carrier 14 that can be pulled out forward from the front side of the housing 2 is provided.

This stacker carrier 14 has a wheel W on the forward bottom surface thereof, and has an upwardly-opened box shape. A plurality of stackers 15 for storing bills are detachably mounted thereinside.

The stacker carrier 14 is slidably supported by slide rails 16 provided in the backward and forward direction on both sides of an opening 4 of the bill processing machine 1.

Here, the stacker carrier 14 is configured such that a lock (not shown) is unlocked by a predetermined operation when the bills in the stackers 15 are recovered or when bills are added to the stackers 15. Thus, desired stacker(s) 15 are detached/attached after the stacker carrier 14 is pulled out.

At a periphery of the opening 4 of the bill processing machine 1, a switch 5 is provided, as in the first embodiment described above.

The switch 5 is arranged between an antenna 8 and an IC chip 7 of an RFID inlet 6 installed on the backside of the bill processing machine 1. The switch 5 is short-circuited when the stacker carrier 14 is in the pulled-out state. On the other hand, the switch 5 is open when the stacker carrier 14 is in the pushed-in state in which the stacker carrier 14 is not pulled out.

That is, in the state with the stacker carrier 14 being pushed in the housing 2, the antenna 8 and the IC chip 7 are disconnected from each other. On the other hand, in the state with the stacker carrier 14 being pulled out, the antenna 8 and the IC chip 7 are connected to generate electric power. The power is then supplied to the IC chip 7, causing the alarm information previously stored to be outputted from the IC chip 7.

Here, the information indicating that the stacker carrier has been pulled out is included in the above-mentioned alarm information.

The configuration of an RFID reader 10 is the same as that in the first embodiment above. Therefore, the description thereof is omitted here.

Thus, according to the other bill processing machine of the first embodiment, when the stacker carrier 14 of the bill processing machine 1 is pulled out and the antenna 8 receives a predetermined radio wave transmitted from the RFID reader 10, electric power is supplied from the antenna 8 to the IC chip 7 and the alarm information is transmitted from the RFID inlet 6. When the alarm information is received by the RFID reader 10, the alarm information is transmitted to an alarm apparatus 11. Therefore, by information, included in the alarm information, indicating that the stacker carrier 14 has been opened, the alarm apparatus 11 can speedily determine not only that the bill processing machine 1 has been opened, but also that the part which has been opened is the stacker carrier 14.

Next, a second embodiment will be described with reference to FIGS. 5 and 6.

The second embodiment has the same configuration as that of the first embodiment above, with the exception being that a shielding material S is used instead of the switch 5 in the first embodiment to restrict transmission of alarm information from an RFID inlet 6. In the following description, similar reference numerals denote similar parts. Description of overlapping parts is omitted.

Figure 5:
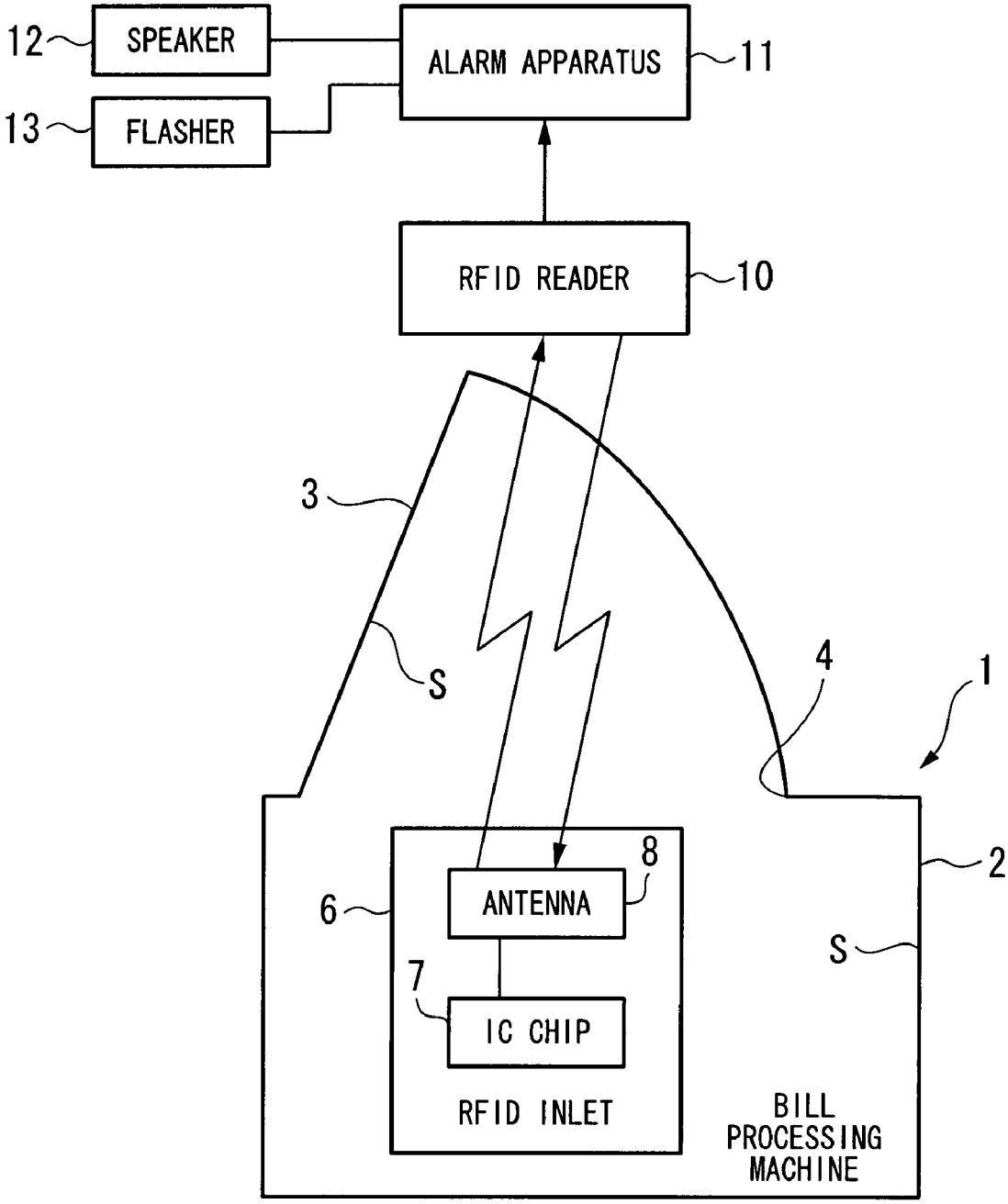
FIG. 5 is a block diagram of a monitoring apparatus according to a second embodiment of this invention.
Figure 6:
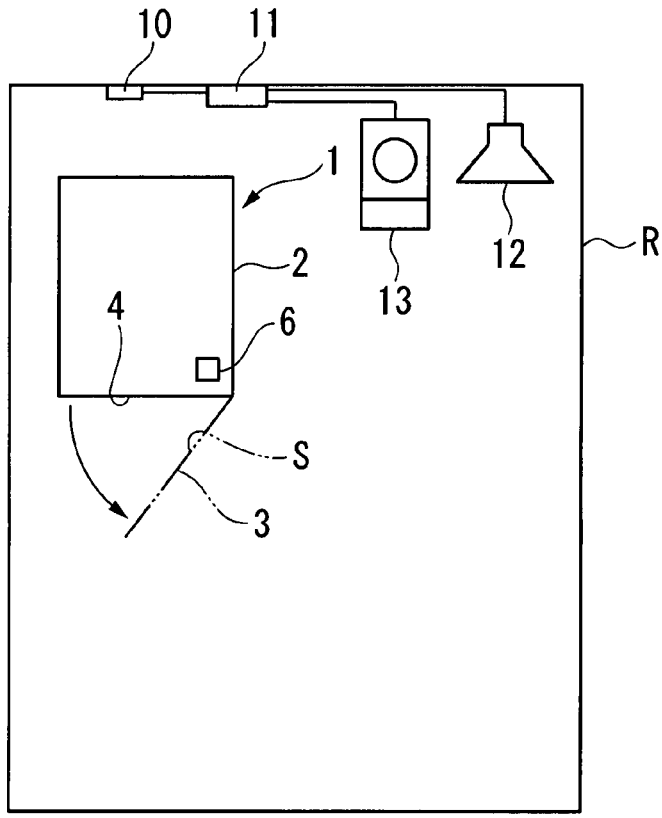
FIG. 6 is a schematic structural diagram of the monitoring apparatus according to the second embodiment of this invention.

As shown in FIGS. 5 and 6, a bill processing machine 1 includes a door 3 at an opening 4 at the front of a housing 2 thereof. Inside the housing 2, the RFID inlet 6 is provided.

The RFID inlet 6 is the same as that in the first embodiment, with the exception being that a switch 5 is not connected thereto. The RFID inlet 6 includes an antenna 8 and an IC chip 7. Electromotive force is generated by the antenna 8 receiving a predetermined radio wave to drive the IC chip 7. Then, alarm information previously stored in the IC chip 7 is transmitted.

On the other hand, an RFID reader 10 is provided on a wall of a room R where the bill processing machine 1 is installed. The RFID reader 10 has the same configuration as that of the first embodiment above. Therefore, a description thereof is omitted here.

The housing 2 and the door 3 mentioned above are coated with a shielding material S (restriction section) in the inside or outside thereof.

The shielding material S is made of a material that does not allow a predetermined radio wave outputted from the RFID reader 10 to pass through.

The type of the shielding material S may be appropriately selected from a variety of shielding materials according to a frequency band of the predetermined radio wave.

Therefore, with the door 3 in the closed state, the predetermined radio wave does not penetrate inside the housing 2. On the other hand, with the door 3 in the open state, the predetermined radio wave penetrates inside the housing 2 from an opening 4 of the housing 2.

Here, the RFID inlet 6 may be installed anywhere inside the housing 2, e.g., on an inside wall surface of the housing 2 or inside surface of the door 3, as long as the communication with the RFID reader 10 is disconnected while the door 3 is in the closed state and the communication with the RFID reader 10 is available while the door 3 is in the open state.

Other than coating the shielding material S on the housing 2 and the door 3 in the inside or outside, the housing 2 and the door 3 themselves may be formed of the shielding material S.

Furthermore, the RFID inlet 6 may be contained in a small shielding box that is provided independently of the housing 2 and is coated with or made of the shielding material S.

In this case, an opening/closing section which works in association with the door 3 may be provided to the shielding box such that the opening/closing section is opened only when the door 3 is opened so as to allow a predetermined radio wave to penetrate from the outside of the housing 2 into the inside of the shielding box.

Thus, according to the second embodiment above, the predetermined radio wave can reach the antenna 8 only when the door 3 is opened without the use of the switch 5. As a result, the IC chip 7 can be driven to transmit alarm information only when the door 3 is open. Therefore, even if power is not supplied to the bill processing machine 1, opening of the door 3 can be detected to cause the alarm apparatus 11 to raise an alarm.

Next, another bill processing machine of the second embodiment above will be described with reference to FIG. 7.

In the other bill processing machine of the second embodiment, only the bill processing machine 1 is replaced by a bill processing machine 1 having a stacker carrier 14, as in the other bill processing machine of the first embodiment. Therefore, description will be made in the condition that similar reference numerals denote similar parts. Description of overlapping parts is omitted.

Figure 7:
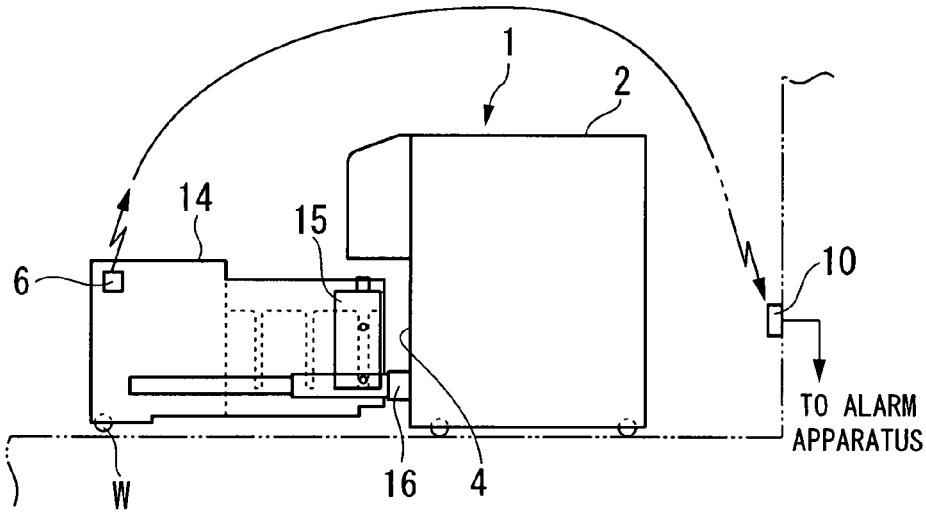
FIG. 7 is a schematic structural diagram of another monitoring apparatus according to the second embodiment of this invention.

As shown in FIG. 7, to the bill processing machine 1, the stacker carrier 14 that can be pulled out forward from the front side of the machine is provided.

The stacker carrier 14 has a wheel W on the forward bottom surface thereof, and has an upwardly-opened box shape. A plurality of stackers 15 for storing bills are detachably mounted inside the stacker carrier 14.

The stacker carrier 14 is slidably supported by slide rails 16 provided in the backward and forward direction on both sides of an opening 4 of the bill processing machine 1.

The bill processing machine 1 is coated with a shielding material S on the outside or inside thereof such that a predetermined radio wave does not penetrate inside the bill processing machine 1 while the stacker carrier 14 is pushed in.

An RFID inlet 6 is mounted on an inside surface of the forward portion of the stacker carrier 14. Thus, the RFID inlet 6 is configured such that only while the stacker carrier 14 is pulled out, a predetermined radio wave outputted from the RFID reader 10 reaches an antenna 8 to cause alarm information to be wirelessly transmitted from the RFID inlet 6.

Furthermore, as in the above described second embodiment, the RFID reader 10 connected to an alarm apparatus 11 is provided on a wall of a room R that faces the backside of the bill processing machine 1.

Here, information indicating that the stacker carrier 14 has been pulled out is included in the alarm information transmitted from the RFID inlet 6.

The case where the RFID reader 10 is installed on the wall of the room R that faces the backside of the bill processing machine 1 has been described. However, from the viewpoint of communications reliability, it is preferable that the RFID reader 10 be installed on the ceiling, since nothing shields the radio wave between the RFID reader 10 and the RFID inlet 6.

Thus, according to the other bill processing machine of the second embodiment, when the stacker carrier 14 of the bill processing machine is pulled out, a predetermined radio wave outputted from the RFID reader 10 reaches the antenna 8, and alarm information is wirelessly transmitted from the RFID inlet 6. When the RFID reader 10 receives the alarm information, the alarm information is transmitted to the alarm apparatus 11. By information, included in the alarm information, indicating that the stacker carrier 14 has been opened, the alarm apparatus 11 can speedily determine not only that the bill processing machine 1 has been opened, but also that the part which has been opened is the stacker carrier 14.

Next, a third embodiment of this invention will be described with reference to FIG. 8.

The third embodiment is a modification of the first embodiment above, in which the alarm apparatus 11 is connected to a monitoring center 17. Therefore, the description will be made in the condition that similar reference numerals denote similar parts. Overlapping description is omitted.

Figure 8:
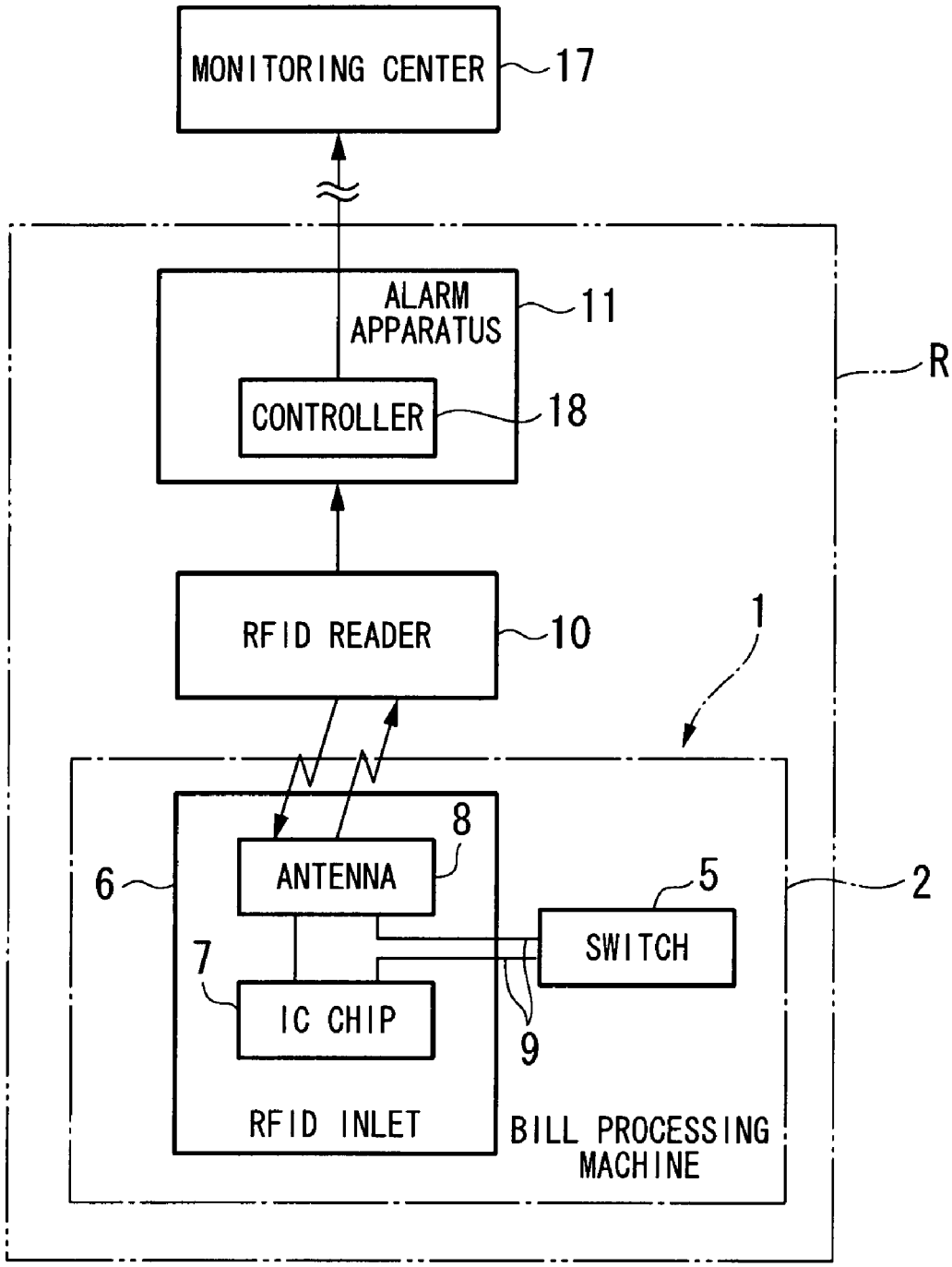
FIG. 8 is a block diagram of a monitoring apparatus according to a third embodiment of this invention.

In FIG. 8, a speaker 12 and a flasher 13 that are connected to an alarm apparatus 11 are omitted.

As shown in FIG. 8, an RFID reader 10 is provided in a room R in which a bill processing machine 1 is installed.

The RFID reader 10 is connected to the alarm apparatus 11, as is already described in the first embodiment.

To the alarm apparatus 11, a controller (controller) 18 that, in response to receiving alarm information from the RFID reader 10, outputs a signal to the effect that an opening/closing operation (abnormal condition) of the door 3 has occurred is connected. The controller 18 is connected to, for example, a monitoring center 17 of a security firm, etc., on a dedicated line.

That is, when the RFID reader 10 receives alarm information as a result of the door 3 of the bill processing machine 1 having been opened or the stacker carrier 14 having been pulled out, the controller 18 in the alarm apparatus 11 outputs to the monitoring center 17 a signal to the effect that an opening/closing operation (abnormal condition) has occurred.

Thus, according to the third embodiment, after the RFID reader 10 has received the alarm information, not only can an alarm be raised by the alarm apparatus 11, but also the occurrence of the abnormal condition can be reported to the monitoring center 17 via the controller 18 of the alarm apparatus 11. Therefore, for example, security staff can be speedily dispatched to the occurrence location. As a result, a monitoring level can be improved.

In the third embodiment, an example has been shown in which the controller 18 is provided to the alarm apparatus 11 of the first embodiment so as to output, to the monitoring center 17, a signal to the effect that an opening/closing operation (abnormal condition) of the door 3 has occurred. However, such that the controller 18 is provided to the alarm apparatus 11 of the other bill processing machine of the first embodiment, the second embodiment, and the other bill processing machine of the second embodiment so as to output, to the monitoring center 17, a signal to the effect that opening/closing operations (abnormal conditions) of the door 3 and the stacker carrier 14 have occurred, may be configured.

In each of the above-described embodiments, an example has been described in which this invention is applied to the bill processing machine 1. However, application of this invention is not limited to the bill processing machine 1. This invention may be adopted in, for example, a coin processing device, a safe, etc., as long as it includes a housing 2.

Also, the description has been made of the case where this invention is applied to one in which the door 3 or the stacker carrier 14 is used as an opening/closing section of the housing 2. However, for example, opening/closing of a lid, etc., may be adapted to be monitored as long as it can be opened/closed.

Furthermore, a plurality of RFID inlets 6 may be provided as communication targets for one RFID reader 10. A plurality of RFID readers 10 may be installed in one room R.

In the case in which a plurality of RFID inlets 6 are provided for one RFID reader 10, it is advantageous in terms of cost since the number of the installed RFID readers 10 can be reduced. On the other hand, in the case in which a plurality of RFID readers 10 are installed in one room R, an opening/closing operation (abnormal condition) of opening/closing sections, that is, the door 3 and the stacker carrier 14 can be detected, if the RFID inlet 6 can communicate with any of the plurality of the installed RFID readers 10. Therefore, it is advantageous in that an opening/closing operation (abnormal condition) of opening/closing sections, that is, the door 3 and the stacker carrier 14 can be more reliably detected, with less sensitivity to radio wave conditions.

Furthermore, such that a shielding material S that can shield the radio wave of alarm information wirelessly transmitted from the RFID inlet 6 is used instead of a shielding material S that shields the predetermined radio wave, so as to prevent the alarm information from reaching the RFID reader 10 while the door 3 is closed, may be configured.

What is claimed is:

1. A monitoring apparatus for a housing, comprising:

an opening/closing section provided to the housing;

a detection section provided to the housing, having a wireless IC chip in which alarm information is pre-stored, and an antenna driving the wireless IC chip with a driving electric power induced by receiving a predetermined radio wave and wirelessly transmitting the alarm information outputted from the wireless IC chip;

a reader provided independently outside the housing, and outputting the predetermined radio wave and receiving the alarm information transmitted from the detection section; and a restriction section restricting a transmission of the alarm information when the opening/closing section is in a closed state.

2. The monitoring apparatus for a housing according to claim 1, wherein the alarm information includes ID data of an occurrence position of an opening/closing operation for identifying the occurrence position of the opening/closing operation of the opening/closing section, and the ID data of the occurrence position of the opening/closing operation includes ID data assigned to every housing for identifying the housing or ID data assigned for every opening/closing section for identifying the opening/closing section.

3. The monitoring apparatus for a housing according to claim 1, wherein the opening/closing section is a drawer, and the alarm information includes information indicating that the drawer is in a pulled-out state.

4. The monitoring apparatus for a housing according to claim 1, wherein the opening/closing section is a door, and the alarm information includes information indicating that the door is in an open state.

5. The monitoring apparatus for a housing according to claim 1, wherein the reader includes a storage section that, in receiving the alarm information, stores the alarm information and an occurrence time of an opening/closing operation when the reader received the alarm information.

6. The monitoring apparatus for a housing according to claim 1, wherein the restriction section is made of a shielding material that shields the predetermined radio wave.

7. The monitoring apparatus for a housing according to claim 1, wherein the restriction section is a switch that is in a conductive state only when the opening/closing section is in an open state, and the switch is arranged between the wireless IC chip and the antenna.

8. The monitoring apparatus for a housing according to claim 7, wherein at least the antenna of the detection section is provided on a backside of the housing.

9. The monitoring apparatus for a housing according to claim 8, wherein the reader is located at a position facing the backside of the housing.

10. The monitoring apparatus for a housing according to claim 1, further comprising an alarm system connected to the reader, including an alarm section that raise an alarm, and controlling the alarm section based on the alarm information received by the reader.

11. The monitoring apparatus for a housing according to claim 1, further comprising an alarm system connected to the reader, and including a controller that transmits a detection signal to a monitoring center when the alarm information is received from the reader.

12. The monitoring apparatus for a housing according to claim 1, wherein a plurality of the readers is provided.

13. The monitoring apparatus for a housing according to claim 1, wherein the housing is a housing of a bill and coin processing device.

14. The monitoring apparatus for a housing according to claim 13, wherein the reader is set so as to be activated upon shut-off of electric power for the bill and coin processing device.

* * * * *